US005875651A

United States Patent [19]

Hill et al.

[11] Patent Number: 5,875,651

[45] Date of Patent: Mar. 2, 1999

[54] LOW VIBRATION THROTTLING DEVICE FOR THROTTLE-CYCLE REFRIGERATORS

[75] Inventors: Dennis Hill, Harleysville, Pa.; Boris Yudin, Moscow Region; Mikhail Boiarski, Moscow, both of Russian Federation; Noel Fasnacht, Allentown, Pa.

[73] Assignee: APD Cryogenics, Inc., Allentown, Pa.

[21] Appl. No.: 874,122

[22] Filed: Jun. 12, 1997

[51] Int. Cl.[6] ..... F25B 41/06

[52] U.S. Cl. ..... 62/511; 138/44

[58] Field of Search ..... 62/511, 527; 138/42, 138/44

[56] References Cited

U.S. PATENT DOCUMENTS

| | | | |
|---|---|---|---|
| 2,448,315 | 8/1948 | Kunzog | 62/511 |
| 2,576,610 | 11/1951 | Kunzog | 62/511 |
| 3,150,502 | 9/1964 | Tucker | 62/511 |
| 3,285,030 | 11/1966 | Coyne | 62/511 |
| 4,150,696 | 4/1979 | Meier et al. | 138/44 |
| 4,406,134 | 9/1983 | Vakil | 62/511 |
| 5,097,866 | 3/1992 | Shapiro-Baruch et al. | 62/511 |

*Primary Examiner*—William E. Tapolcal
*Attorney, Agent, or Firm*—Helfgott & Karas, P.C.

[57] ABSTRACT

A throttle device provides a large number of small flow channels generally in parallel rather than a single flow path. The throttling device, a porous cartridge within a tube, may be porous metal, packed ferrous spheres or other particles, packed fibrous material, a plurality of smaller capillaries joined together in parallel, etc. The number and size of the channels provide proper pressure drop performance of the throttle, and flow is laminar with a Reynolds number less than 2,000. Vibrations are low. With certain refrigerant components, and small openings in the porous throttle device, refrigerant flow resistance increases until all flow ceases below selected and repeatable temperature levels. Thus, a temperature-dependent, variable on to off throttle device is provided without moving parts. This self adjusting throttle device can operate in parallel with a fixed throttle device.

20 Claims, 7 Drawing Sheets

LOW VIBRATION THROTTLING DEVICE FOR THROTTLE-CYCLE REFRIGERATORS

BACKGROUND OF THE INVENTION

This invention relates generally to a refrigerant flow control device in a closed cycle refrigeration system, and in particular to a flow controller or throttle device that provides rapid cool down and low vibration steady-state performance.

Every throttle cycle refrigerator incorporates a throttling device as a means for reducing the refrigerant pressure from the compressor discharge before the refrigerant flow enters the evaporator. However, accomplishing this pressure change is complicated by the fact that operating conditions are significantly different at start up of a warm system as compared to steady-state operation at desired loads and operating temperatures. For good overall performance, the throttling device should provide the desired vapor pressure in the evaporator under steady-state conditions and also during cool down.

For fast cool down, it is necessary that the refrigerant flow rate be higher than at steady state operating conditions. Thus at cool down, it is desirable that the return pressure to the compressor be high enough to provide sufficient flow rate through the system; compressor pumping capacity increases as the inlet refrigerant pressure to the compressor increases. Unfortunately, a fixed restrictor such as an orifice or capillary tube limits the compressor performance and refrigerant flow rate most just when maximum flow rate would be beneficial. This occurs because at start up the restrictor flows a refrigerant of low average density, that is more gaseous than liquid. Thus, the simplest means used for reducing the pressure of the refrigerant flow, that is, a fixed geometry restrictor such as a capillary tube or small orifice, which are simple in design and easy to manufacture, have low mass flow rates at start up and slow cool down if sized for subsequent steady-state performance.

To improve the cool down characteristic and thereby reduce the cool down time, many constructions of throttling devices have been proposed. For example there are U.S. Pat. Nos. 3,320,755; 3,257,823; 3,457,730, and British patents Nos. 1,164,276 and 1,297,132. Japanese patent No. 24498 (1970) is also of interest. These patents disclose various means for increasing the orifice size in the throttle device during cool down. This increase in orifice size is achieved, for instance, using a needle that is actuated by a gas filled bellows, or by using the difference in thermal expansion of different materials to move the needle relative to an orifice. These throttling devices incorporate many high precision parts, which result in high cost to manufacture and low reliability in performance of the whole device.

Further, in many applications of closed cycle refrigeration systems, vibration is a critical parameter to be controlled. The energy dissipated when refrigerant flow is throttled from high pressure to low pressure, as is required in a closed refrigeration cycle, is a major contributor to vibrations at the cold end of the system. Whereas the vibration induced by the throttle device may be subsequently damped and isolated by special constructions, which add to the complexity of the system at the cold end, elimination of the vibrations where they originate in the throttle device would be advantageous.

Preliminary investigations indicate that vibration as measured at the load interface for the closed cycle refrigeration system has a steady state component and a pulsating component when the system uses a capillary tube throttle. A multi-phase refrigerant, which was used in the investigations, having two liquid phases and one vapor phase flowing through the capillary throttle valve, produced an unacceptable pulsating flow due to the large density change as the refrigerant pressure drops from high pressure compressor discharge to low pressure at the cooler evaporator and the compressor inlet. Smaller diameter capillary tubes increase the refrigerant velocity in the tube for a given mass flow rate of refrigerant. It has been found that this high velocity tends to increase the steady state portion of the throttling vibration.

What is needed is a throttle device for a closed cycle refrigeration system that is simple in construction, provides rapid cool down and produces low vibration at the cold end especially at steady-state conditions.

SUMMARY OF THE INVENTION

Generally speaking, a throttle device in accordance with the invention reduces vibratory effects by operating in a laminar flow region for the refrigerant rather than in a turbulent flow region as is the operational mode of present throttle devices, including orifices and capillary tubes. In an embodiment in accordance with the invention, refrigerant flows through the throttle device through a large number of small channels generally in parallel rather than through a single flow path. In particular, the throttling device is a porous cartridge within a tube so that refrigerant flows through a number of small channels in parallel in the porous cartridge. The porous cartridge may be of different constructions, for example, porous metal, packed ferrous spheres or other particles, packed fibrous material, a plurality of small capillary tubes joined together in parallel, etc. The number and size of the channels provide proper pressure drop performance of the throttle, and flow within the flow paths is laminar. That is, flow has a Reynolds number less than 2,000.

In conventional applications with an orifice or capillary tube, mass flow is in proportion to the refrigerant density and is at low density at the input to the throttle device. Thus, low return pressures at the compressor during cool down were inevitable. To the contrary, the present invention takes advantage of the changes in flow resistance with temperature change to achieve a desired flow pattern. For systems having the same steady-state capacity and operating temperatures, the present invention using a laminar throttle device, provided a cool down time that was significantly less than with a fixed capillary throttle. The laminar throttle device may be used in refrigerators working on mixed refrigerants as well as systems using single component refrigerants to provide varying levels of cool down improvement. The present invention has been effectively utilized in refrigerants operating at temperatures below 220K, but is not so limited.

Additionally, it has been found for many refrigerants used at low temperatures, in closed cycle throttle type refrigeration systems , that changes in refrigerant properties, perhaps viscosity, as temperature drops can have a marked effect on performance of a porous cartridge throttle device. In particular, with certain refrigerant components, and small openings in the porous throttle device, refrigerant flow resistance increases until all flow ceases below selected and repeatable temperature levels. Thus, a temperature-dependent, variable (on to off) throttle device is provided in accordance with the invention, without moving parts.

This self adjusting throttle device can operate in parallel with a fixed throttle device, for example, an orifice or a capillary tube. In start up, the porous cartridge passes high flow that is preferably laminar when vibration is an important parameter, to provide rapid cool down. Near the desired operating temperature, the porous element automatically ceases flow due to increased refrigerant flow resistance. Then, the fixed throttle device determines refrigerant flow to satisfy steady-state conditions.

Accordingly, it is an object of the invention to provide an improved throttle device for a closed cycle refrigeration system that provides rapid cool down to steady state operating conditions.

A further object of the invention is to provide an improved throttle device for a closed cycle refrigeration system that has low levels of vibration at the load cooling interface.

Yet another object of the invention is to provide an improved throttle device for a closed cycle refrigeration system that adjusts performance between cool down mode and steady state operation without moving parts.

Still another object of the invention is to provide an improved throttle device for a closed cycle refrigeration system that is simple in construction and economical to produce.

Yet another object of the invention is to provide an improved throttle device for a closed cycle refrigeration system that operates in conjunction with a conventional fixed steady state throttle device such as a capillary tube or orifice to enhance both cool down and steady-state performance.

This invention accordingly comprises the features of construction, combinations of elements and arrangement of parts which will exemplified in the constructions hereinafter set forth and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF PREFERRED EMBODIMENTS

Figure 1:
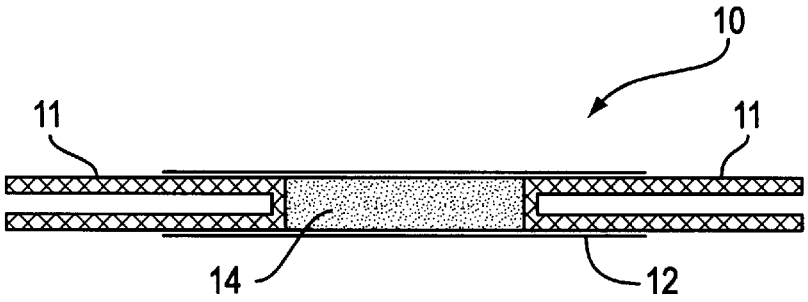
FIG. 1 is a cross sectional view of a laminar throttle device in accordance with the invention, using a porous cartridge.

In FIG. 1, a throttling device 10 in accordance with the invention includes a tube 12 holding a close fitting porous cartridge 14, which provides many very small series-parallel channels for refrigerant flow therethrough. The porous cartridge 14, positioned between connector tubes 11, is made of porous metal having a quantity of channels with channel opening (cross section) dimensions such that in the combination of channel size and quantity of channels, a proper flow performance is provided for the throttle device 10.

Namely, the refrigerant flow through the porous cartridge 14 is laminar as distinguished from the turbulent flow found for the same mass flow in a single capillary tube throttle device or in an orifice. A flow Reynolds number less than 2000 is generally considered to represent laminar flow. The Reynolds number for a channel is determined by calculation using the equation $Re=\rho vd/\mu$, where v is flow velocity, d is equivalent diameter of the channel, $\mu$ is kinematic viscosity of the fluid, and $\rho$ is fluid density.

In alternative embodiments of the porous cartridge 14 in accordance with the invention, the cartridge may be filled with packed spheres, packed fibrous material, a number of small capillaries bound together in parallel, etc. In calculating the Reynolds number, the equivalent diameter for the capillaries is the inside diameter of the tubes, and for the other embodiments, an average size of the channels within the material would be considered as the equivalent diameter.

Figure 2:
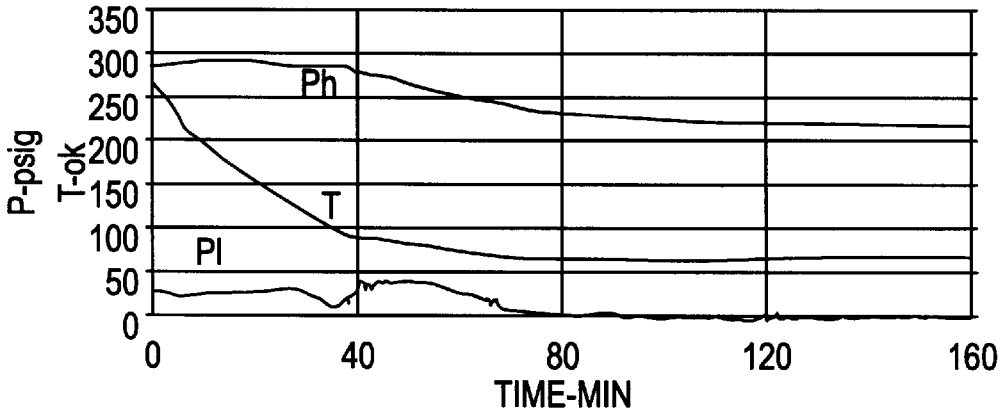
FIG. 2 is a graph illustrating pressure and temperature characteristics of a closed cycle throttle type refrigeration system using the throttle device of FIG. 1.

FIG. 2 illustrates the performance during cool down and steady state operation of a closed cycle refrigeration system using a throttle device of a porous cartridge type 10 in accordance with the invention. The graph illustrates that steady state temperature T at approximately 75K is achieved substantially in 60–80 minutes from start up at room temperature. The high pressure Ph of the system at compressor discharge is also illustrated against time as is the compressor inlet pressure P1. These pressure characteristics indicate the higher thermal load during cool down as compared to steady-state operation. In the test, the porous cartridge included spheres having a diameter of 50 microns, and a five component refrigerant mixture of helium, nitrogen, methane, ethane, and propane was used with the respective proportions of 6, 36, 17, 19 and 22 molar %.

Figure 3:
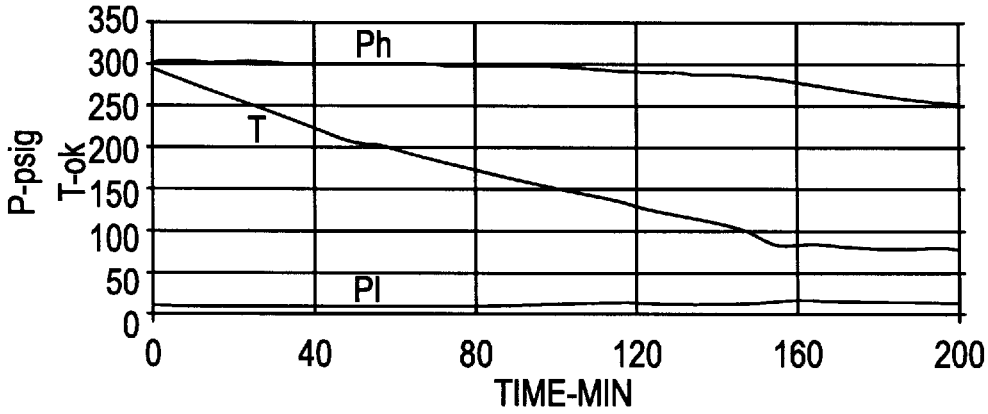
FIG. 3 (PRIOR ART)
FIG. 3 is a graph similar to that of FIG. 2 showing closed cycle refrigeration system performance using a single capillary tube as a throttle device, as in the prior art.

FIG. 3 shows the same refrigeration system functioning during cool down and steady state using a single capillary tube as the throttle device. The capillary tube was selected for its steady-state performance characteristic. Approximately 200 minutes were required to reach the steady-state operating temperature of approximately 750° K.

At start up, the compressor had a higher inlet pressure P1 (FIG. 2) than did the compressor at start up when a single capillary tube was used (FIG. 3). Thus, the compressor was taking in a higher density refrigerant when using the throttle device 10 in accordance with the invention and was capable of pumping a higher mass flow rate (for example, pounds of refrigerant per hour) of refrigerant than did the same compressor operating with a single capillary throttle. Under these circumstances, the more rapid cool down with the throttle device 10 of the present invention is observed. An elevated high pressure Ph at the outlet of the compressor indicates removal of a greater heat load during initial cool down, when using the present invention. Tests were conducted with high pressure Ph in the range of 175 psig to 375 psig.

Such a porous cartridge type throttle device 10 can be used in refrigerators working on mixed refrigerants as in FIGS. 2 and 3 as well as in refrigerators using single component refrigerants. Effective operation was achieved in refrigerators having load temperatures below 220K, but operation at higher load temperatures is not precluded.

Figure 4:
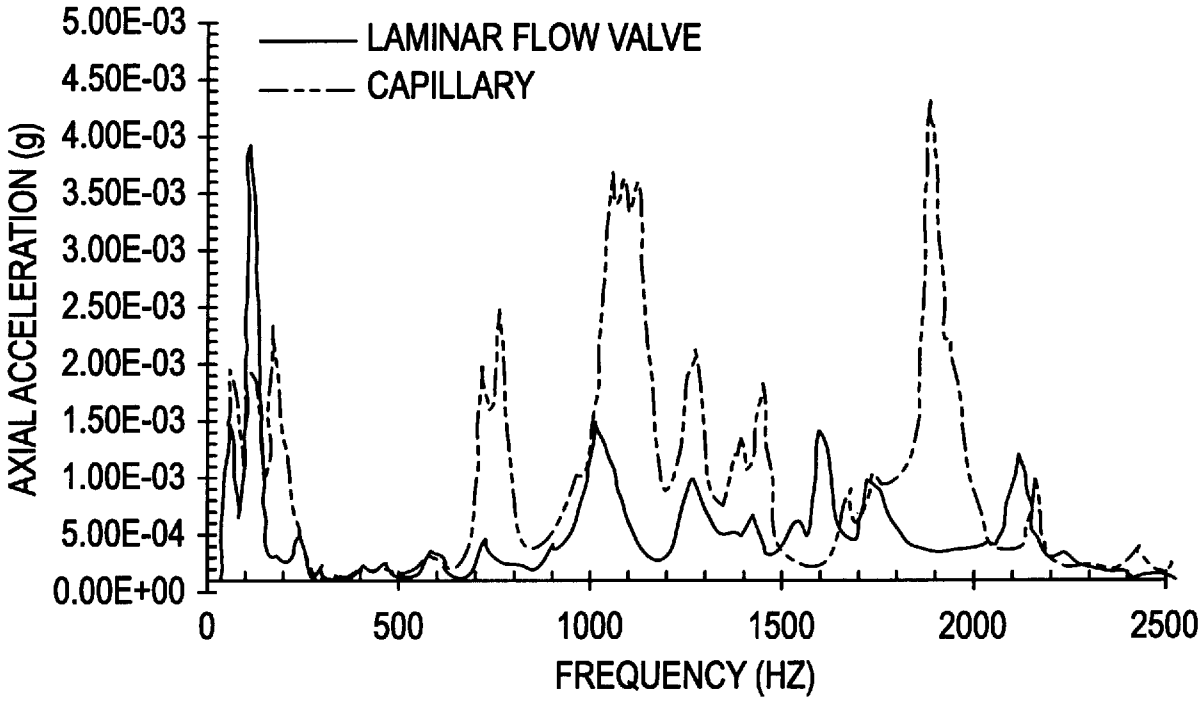
FIG. 4 is a graph of axial acceleration (vibration) versus frequency of vibration at the load interface of closed cycle throttle systems using either a single capillary or a laminar throttle device in accordance with the present invention.

FIG. 4 illustrates the vibration spectrum at the load interface for the same cooler system (FIGS. 2,3) when using a single capillary tube throttle device and when using the laminar flow throttle device. Clearly, the laminar flow device 10 in accordance with the invention produced less vibration, that is, less axial acceleration, as measured at the cold interface used for attachment of a load to be cooled. This advantage was demonstrated over most of the frequency spectrum although not at every frequency.

Using a 5 component mixed refrigerant of neon, nitrogen, methane, ethane, and propane, tests were performed on a closed cycle throttle system using different pore sizes in the porous element 14 in the throttling device 10. Porous material with a pore size greater then 100 microns provided cool down characteristics similar to those presented in FIG. 3 in that the compressor return pressure P1 ran at a substantially steady level both during cool down and also in steady state operation following cool down.

Figure 5:
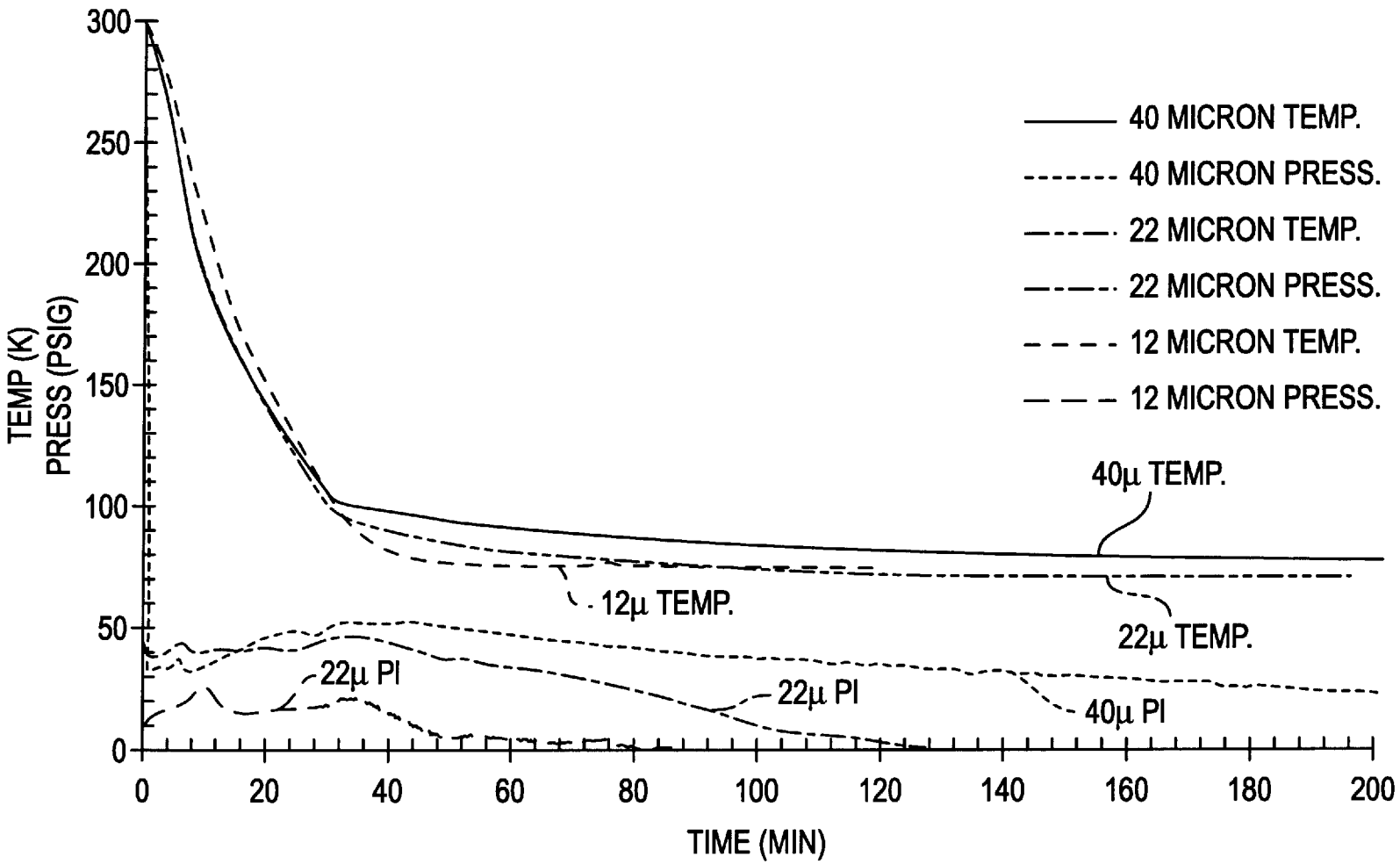
FIG. 5 is a graph of temperature and pressure characteristics versus time in a refrigeration system for throttle devices with different sized porous materials.

Cooling characteristics in a similar refrigeration cycle using porous materials with pore sizes smaller then 100 microns are shown in FIG. 5. As illustrated, in all throttle devices made of porous material smaller then 100 micron pore size, the return pressure at the compressor inlet steadily degraded with time, the rate of degradation increasing with smaller pore size. Since flow rate in a closed cycle refrigeration system is proportional to the return pressure at the compressor inlet, the refrigerant flow rate, e.g. pounds per hour, also decreased. In fact, flow rate decreased to the point where no flow was evident at all through the porous throttle devices. Thus, porous material with pore sizes smaller then 100 microns operated to shut off the flow once the throttle cycle cooler system had reached minimum temperature.

How this phenomenon occurs is not fully explained at this time. It appeared that when minimum temperature has been reached on the low side, the refrigerant flows as a three phase mixture, two liquid phases and a gaseous or vapor phase. It is hypothesized that a liquid phase of the refrigerant became so viscous and resistant to flow that the compressor no longer developed a sufficient pressure differential to move the refrigerant through the pores of the throttle valve. Samples of the gas mixture taken from the high pressure side of the throttle device, just upstream of the porous material, after refrigerant flow had stopped, showed a high concentration of the ethane/propane components as compared with gas samples taken downstream of the throttle device. Thus, it appears that the ethane/propane components were the substance that becomes so viscous that it completely shut down the flow of refrigerant through the pores.

In systems where a lubricant circulates with the refrigerant, this substance may be a factor in the on to off flow characteristic of the porous member as temperature drops. Thus in this application, a "refrigerant mixture" also includes any circulating lubricant.

Reduced vibration, as compared to use of a single capillary, was achieved with the porous material with laminar flow, whether or not the pore size is greater or less then 100 microns. Basically to minimize vibration, the refrigerant mass flow rate must be reduced to the minimum which is practical to keep the cryogenic cooler and the device to be cooled at the desired minimum temperature.

For operation of porous elements in the flow restrictor at steady state temperature and flow therethrough, pore sizes in the approximate range of 50 micron to 600 micron are indicated, with a preferred range of approximately 80 micron to 120 micron.

For operation of porous elements in the flow restrictor at steady state temperature and with blocked refrigerant flow, pore sizes in the approximate range of 0.1 micron to 100 micron are indicated, with a preferred range of approximately 10 micron to 70 micron.

Clearly small pore size material in the throttle device has limited use by itself when the desired refrigerating temperature results in high flow resistance of refrigerant components and causes shut down of flow.

The following embodiments incorporate the on to off characteristic of porous materials at low temperatures as it affects refrigerant flow to provide a closed cycle with improved cool down characteristics and independent control of steady state mass flow rate.

Figure 6:
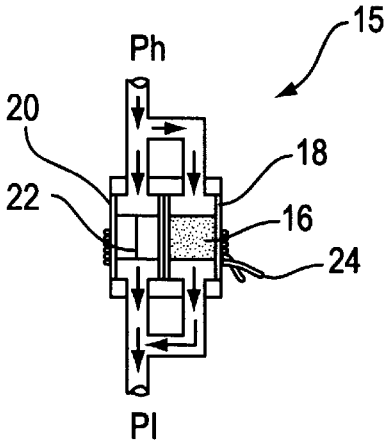
FIG. 6 is a dual restrictor construction, schematically, in accordance with the invention.

In FIG. 6, a porous material 16 of pore size, for example, substantially less than 100 microns, is pressed into a tube 18 which is in parallel with a second tube 20 in which a fixed orifice fitting 22 is installed with a press fit. As both the porous material 16 and the fixed orifice fitting 22 are readily available commercially, an extremely simple and cost effective design is possible. During cool down, refrigerant flow entering the device 15 at Ph, splits into two paths and flows through the porous material 16 and through the orifice 22. Refrigerant leaves the device 15 at reduced pressure P1. At the start of cool down, flow of refrigerant through the porous material 16 is far greater then flow through the orifice 22 for reasons discussed above, namely, the refrigerant entering the retractors is of low density and little mass of gaseous refrigerant will flow through the orifice 22.

As cool down progresses, the temperature of the throttle device 15 itself decreases, more liquid refrigerant enters at Ph, and the amount of flow through the orifice 22 increases. However, with increasing flow resistance of some refrigerant components as temperature falls, flow through the porous material 16 begins to diminish. The porous material element 16 is selected and dimensioned such that at a preselected temperature, flow through the porous material 16 is entirely blocked and only flow through the orifice 22 continues. This blocking temperature would be at or near the intended steady state operating temperature. When the two throttling devices 16, 22 are in good thermal contact, the fastest cool down is achieved.

Figure 7:
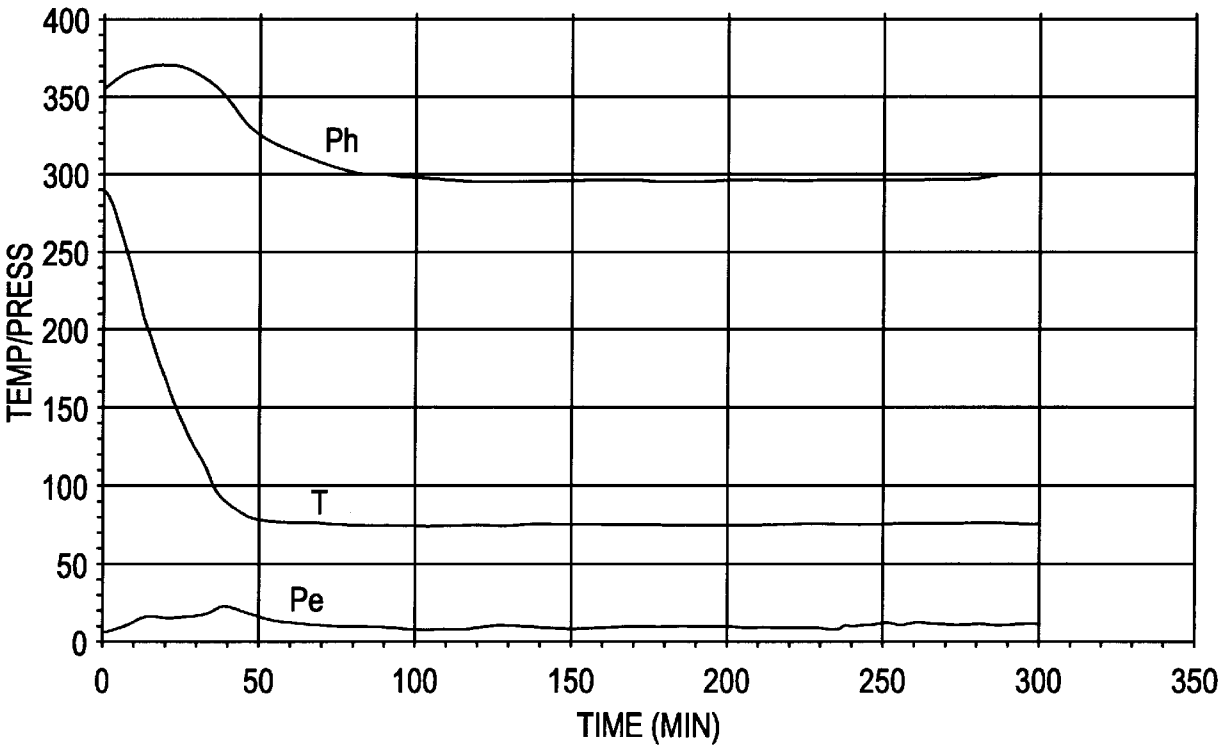
FIG. 7 is a graph of temperature and pressure versus time for the dual restrictor construction of FIG. 6.

The embodiment of FIG. 6 was tested using 10 micron porous material and a 0.15 millimeter orifice. FIG. 7 illustrates the cool down performance. This dual restrictor assembly resulted in fast cool down with low vibration due to the low steady state flow rate. The porous material cut off flow at 75K. Thermal contact between the restrictor elements was improved by a length of copper wire 24 wrapped tightly around both elements. In an alternative embodiment in accordance with the invention, both the porous material 16 and the fixed orifice fitting 22 may be pressed into an integral machined valve body (not shown).

Figure 8:
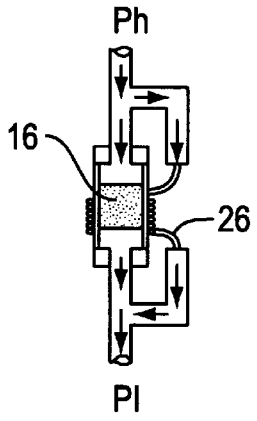
FIG. 8 is an alternative embodiment of a dual throttle device in accordance with the invention.

FIG. 8 illustrates an alternative embodiment of the FIG. 6 construction, wherein the fixed orifice 22 is replaced by a fixed capillary tube 26. Again, the porous material 16 is the dominant factor in accelerating cool down whereas the capillary tube 26 determines the steady state performance values with the porous material blocked to flow.

Figure 9:
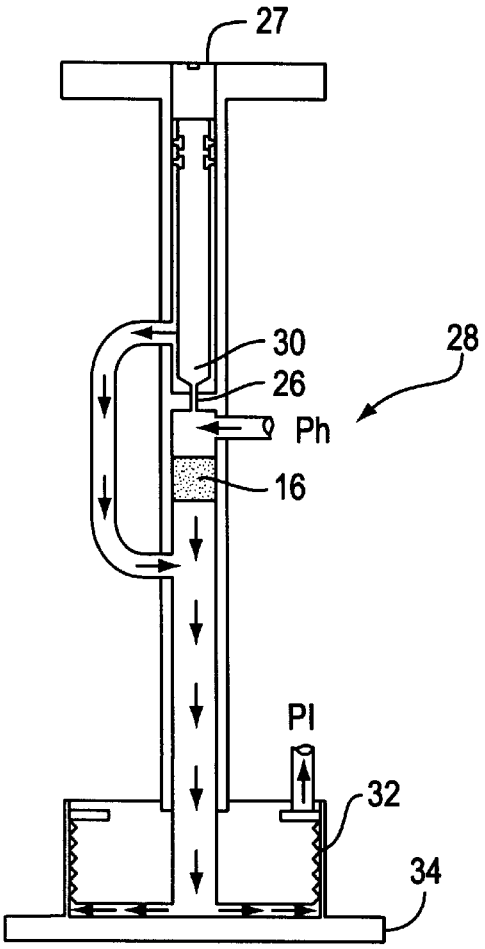
FIGS. 9, 10 and 11 are further alternative embodiments of dual throttle devices in accordance with the invention.

In FIG. 9, the fine pore size porous material 16 is the main refrigerant flow path from Ph to P1 during cool down as the orifice 26 passes little refrigerant at the start of cool down due to the low density condition at the orifice inlet. As time passes and the temperature of the device 28 drops, more flow passes through the orifice 26 and flow through the porous material 16 is finally cut off at a predetermined temperature due to the increase in flow resistance of at least a component of the refrigerant. The steady-state refrigerant flow rate can be pre-adjusted or adjusted at steady-state by turning the valve adjustment stem 27, which moves the needle 30 relative to the orifice 26.

Refrigerant at pressure P1 flows over an integrally extended heat transfer surface 32 and adjacent to a thermally connected cold plate 34 for interfacing with the object to be cooled (not shown).

Throttle devices of similar function in the prior art, for example, U.S. Pat. No. 5,595,065, issued Jan. 21, 1997, and owned by the assignee of the present application, used a plastic actuator and spring to accomplish the results that are achieved without any moving parts in the embodiment of FIG. 9.

Figure 10:
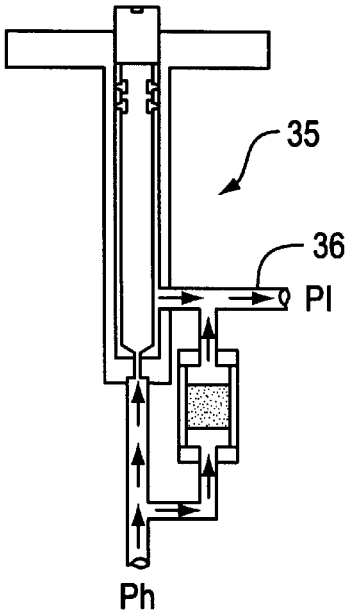

FIG. 10 provides flow paths similar to the embodiment of FIG. 9 except that the heat transfer surface 32 and cold plate 34 are not directly connected to the throttle device 35. These elements of a closed cycle refrigeration system would be connected by copper tubing 36 at P1, whereby the throttle device 35 is adaptable for many different cooling applications.

Figure 11:
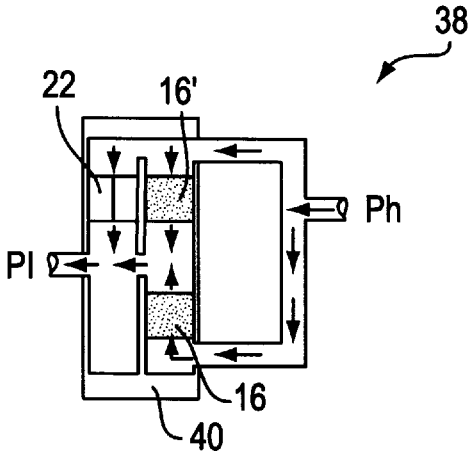

In FIG. 11, a throttle device 38 includes a fixed orifice 22 arranged in parallel with a parallel pair of porous material elements 16, 16'. The porous material 16, 16' may be of the same or different pore sizes and cut off temperatures, so as to tune the device 38 to a desired cool down time. An integrated valve body 40 holds the three throttle elements 16, 16', 22, but two independent bodies could be used, preferably held together with a highly conductive wire such as copper for good thermal contact between all elements.

In each instance, the fixed orifice that is used for steady state operation is dimensioned for a low refrigerant flow velocity. Thus, the vibrations delivered at the cold interface with the object to be cooled are vastly reduced over the conventionally sized capillary tube that was used in the prior art to perform both the cool down and steady state performance functions. In the dual constructions in accordance with the invention, a fixed orifice caused substantially less vibration than a fixed capillary tube in the same steady-state operating system.

Figure 12:
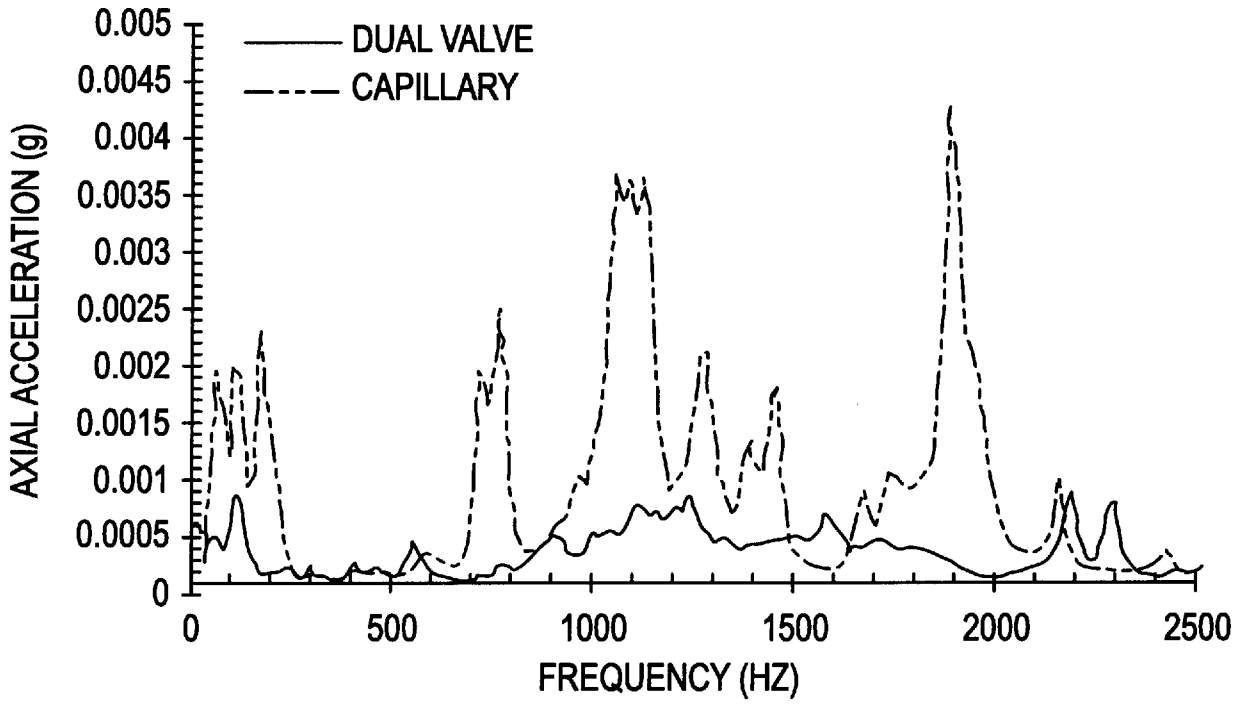
FIG. 12 is a graph similar to FIG. 4 showing comparative performance of a single capillary tube and the dual throttle device in accordance with the invention.

FIG. 12 provides a comparison in vibration (axial acceleration) at the load interface using a dual type throttle device with a fixed orifice in accordance with the present invention during steady-state operation, as compared to a conventional single capillary tube system of the prior art. The data was obtained in a refrigeration system that differed only in the throttle device. No extreme peaks of vibration were determined using the dual throttle device, which generally provided lower vibration at almost every frequency.

With regard to FIG. 12, the orifice diameter was 0.13 mm and the orifice length was approximately 0.25 mm. The porous material was a standard item available from Mott Metalurgical Corporation, Farmington, Conn., #5000-1/4-1000. Pore size was approximately 10 microns. The compressor was a one CFM rolling piston type. The capillary tube was 91 centimeters long and had an I.D. of 0.66 mm.

For both the capillary and the dual throttle device test, the refrigerant composition was neon 8% molar, nitrogen 35% molar, methane 18% molar, ethane 19% molar, propane 20% molar. From tests it has been demonstrated that the dual throttle device operates satisfactorily with refrigerant having ranges of components neon 0.5–22%, nitrogen 30–40%, methane 15–20%, ethane 12–21% and propane 14–32%. There is no basis to assume that even wider ranges will not be effective. Helium or Hydrogen in the same percentage can replace the neon in the refrigerant composition.

Figure 13:
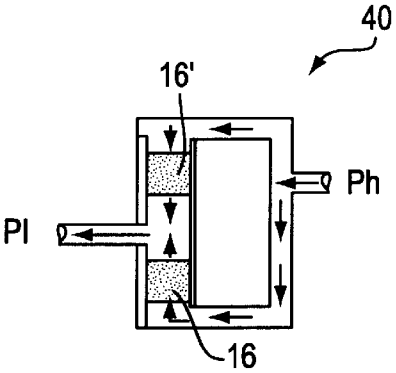
FIG. 13 is another alternative embodiment in accordance with the invention of a dual throttle device.

FIG. 13 illustrates a dual valve construction 40 having a first porous material 16 to provide a cool down flow path during start up operation and a second porous material 16' in a second parallel flow path that serves during cool down but serves primarily for steady-state operation.

At the start of cool down, the first porous material path passes the majority of refrigerant flow to provide rapid cool down. However, as the low operating temperature is achieved, the first porous material 16 clogs due to the increased flow resistance of at least a component of the refrigerant and only the second porous material 16' provides a flow path for steady-state refrigeration. The second porous material is sized both in size and quantity of flow paths so that the second porous material does not clog at operating temperature but provides steady-state laminar flow with the resultant low vibrations at the interface with the load to be cooled.

It will thus be seen that the objects set forth above, among those made apparent from the preceding description, are efficiently attained and, because certain changes may be made in the above constructions without departing from the spirit and scope of the invention, it is intended that all matter contained in the above description and shown in the accompanying drawings shall be interpreted as illustrative and not in a limiting sense.

What is claimed is:

1. A closed cycle refrigeration system, comprising:

a first throttle device connecting between a high pressure portion of said closed cycle system and a low pressure portion of said closed cycle refrigeration system, said first throttle device including a high pressure inlet for refrigerant and a low pressure outlet for refrigerant, and a first flow restrictor in a first flow path between said inlet and said outlet, refrigerant flowing in said first flow path passing through said first flow restrictor, said first flow restrictor being at least one of porous metal, plastic, glass, ceramic, packed spheres, particles, fibrous material, and capillary tubes in parallel, a plurality of paths in said first flow restrictor being dimensioned for laminar flow of said refrigerant through said first flow restrictor, cool/down time and vibrations being reduced by said first throttle devices, a second throttle device in a second refrigerant flow path, said second flow path and second throttle device being in flow parallel with said first flow path and first throttle device, said second throttle device being dimensioned for performance with laminar flow at selected steady-state conditions of said refrigeration system said second throttle device including one of a capillary tube, fixed orifice, and a second flow restrictor with a plurality of flow paths.

2. A closed cycle refrigeration system for operation at a Pre-selected steady-state temperature T for cooling a load, comprising:

a refrigerant mixture for operation at temperature T including at least one component that increases in flow resistance as its temperature decreases;

a first throttle device connecting between a high pressure portion of said closed cycle system and a low pressure portion of said closed cycle system, said first throttle device including a high pressure inlet for said refrigerant and a low pressure outlet for said refrigerant, and a first flow restrictor in a first flow path between said inlet and outlet, said refrigerant flowing in said first flow path passing through said first flow restrictor, said refrigerant mixture in flowing through said first flow restrictor being increasingly restricted by increases in said flow resistance as said refrigerant is cooled toward temperature T, wherein said first flow restrictor becomes blocked to said refrigerant mixture at a temperature not exceeding said pre-selected temperature T.

3. A refrigeration system as in claim 2, wherein said first flow restrictor is at least one of porous metal, plastic, glass, ceramic, packed spheres, particles, fibrous material, and capillary tubes in parallel.

4. A refrigeration system as in claim 2, wherein said first flow restrictor is a porous plug having a plurality of flow paths with a pore size in a range of approximately 0.1 micron to 100 micron.

5. A refrigeration system as in claim 4, wherein said pore size is in a range of approximately 10 micron to 70 micron.

6. A refrigeration system as in claim 4, wherein said refrigerant mixture includes at least ethane and propane components.

7. A refrigeration system as in claim 6, wherein said refrigerant mixture further includes neon, nitrogen and methane components.

8. A refrigeration system as in claim 4, wherein said mixture is neon 0.5–22%, nitrogen 30–40%, methane 15–20%, ethane 12–21%, and propane 14–32%, said percentages being molar.

9. A refrigeration system as in claim 4, wherein said refrigerant mixture includes helium, argon, ethylene, and propane.

10. A refrigeration system as in claim 9, wherein helium is 6 mole %, argon is 36 mole %, ethylene is 21 mole %, and propane is 37 mole %.

11. A closed cycle refrigeration system for operation at a steady-state temperature T for cooling a load, comprising:

a refrigerant mixture for operation at temperature T including at least one component that increases in flow resistance as its temperature decreases;

a first throttle device connecting between a high pressure portion of said closed cycle system and a low pressure portion of said closed cycle system, said first throttle device including a high pressure inlet for said refrigerant and a low pressure outlet for said refrigerant, and a first flow restrictor in a first flow path between said inlet and outlet, said refrigerant flowing in said first flow path passing through said first flow restrictor, said refrigerant mixture in flowing through said first flow restrictor being increasingly restricted by increases in said flow resistance as said refrigerant is cooled toward temperature T, and a second throttle device in a second refrigerant flow path, said second flow path and second throttle device being in flow parallel with said first flow path and first flow throttle device, said second throttle device being dimensioned for performance at selected steady-state conditions of said refrigerant system.

12. A refrigeration system as in claim 11, wherein said second throttle device includes one of a capillary tube, orifice, and a second flow restrictor with a plurality of flow paths.

13. A refrigeration system as in claim 11, wherein said second throttle device is dimensioned to remain open to refrigerant flow at temperature T.

14. A refrigeration system as in claim 13, wherein said second flow restrictor is a porous plug and said plurality of flow paths have a pore size in a range of approximately 50 micron to 600 micron.

15. A refrigeration system as in claim 13, wherein said refrigerant mixture includes at least ethane and propane components.

16. A refrigeration system as in claim 11, wherein said second flow restrictor is at least one of porous metal, plastic, glass, ceramic, packed spheres, particles, fibrous material, and capillary tubes in parallel.

17. A refrigeration system as in claim 14, wherein said pore size is in a range of approximately 80 micron to 120 micron.

18. A refrigeration system as in claim 14, wherein said pores are selected by quantity and flow area for laminar flow.

19. A refrigeration system as in claim 11, wherein said first throttle device is dimensioned to close to said refrigerant flow in said first flow path at temperature T.

20. A refrigeration system as in claim 19, wherein said second throttle device is dimensioned to remain open to refrigerant flow at temperature T.

* * * * *